US011791123B2

(12) United States Patent
Song et al.

(10) Patent No.: US 11,791,123 B2
(45) Date of Patent: Oct. 17, 2023

(54) X-RAY TUBE

(71) Applicant: Electronics and Telecommunications Research Institute, Daejeon (KR)

(72) Inventors: Yoon-Ho Song, Daejeon (KR); Jun-Tae Kang, Daejeon (KR); Jae-Woo Kim, Daejeon (KR); Jin-Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/712,639

(22) Filed: Apr. 4, 2022

(65) Prior Publication Data

US 2022/0351929 A1 Nov. 3, 2022

(30) Foreign Application Priority Data

Apr. 29, 2021 (KR) ..... 10-2021-0055725
Feb. 23, 2022 (KR) ..... 10-2022-0023495

(51) Int. Cl.
*H01J 35/16* (2006.01)
*H01J 35/06* (2006.01)
*H01J 35/04* (2006.01)

(52) U.S. Cl.
CPC ..... *H01J 35/16* (2013.01); *H01J 35/045* (2013.01); *H01J 35/064* (2019.05)

(58) Field of Classification Search
CPC ..... H01J 35/16
See application file for complete search history.

(56) References Cited

U.S. PATENT DOCUMENTS 7,236,568 B2 6/2007 Dinsmore et al.
10,825,641 B2 11/2020 Ishii et al.
2005/0213709 A1 9/2005 Dinsmore et al.
2007/0121788 A1* 5/2007 Mildner ..... H01J 35/04 378/138
2010/0290588 A1* 11/2010 Kilian ..... H01J 35/18 378/57

(Continued)

FOREIGN PATENT DOCUMENTS

JP 4876047 B2 12/2011
JP 2019-186089 A 10/2019

(Continued)

*Primary Examiner* — Chih-Cheng Kao
(74) *Attorney, Agent, or Firm* — NSIP Law

(57) ABSTRACT

Provided is an X-ray tube which includes a first electrode, a second electrode spaced apart from the first electrode, a target disposed in a lower portion of the second electrode, an emitter on the first electrode, a third electrode which is positioned between the first electrode and the second electrode and includes an opening at a position perpendicularly corresponding to the emitter, and a spacer provided on the third electrode and surrounding the second electrode. The spacer includes a first section located adjacent to the third electrode and a second section disposed on the first section. The spacer includes a ceramic insulator and conductive dopants dispersed within the ceramic insulator. A concentration of the conductive dopants in the first section of the spacer is greater than a concentration of the conductive dopants in the second section. The third electrode is in contact with the first section of the spacer.

20 Claims, 4 Drawing Sheets

(56) References Cited

U.S. PATENT DOCUMENTS

| | | | | |
|---|---|---|---|---|
| 2014/0161232 | A1 | 6/2014 | Jeong et al. | |
| 2017/0053771 | A1* | 2/2017 | Jeong | H01J 35/065 |
| 2018/0247787 | A1 | 8/2018 | Jeong et al. | |
| 2019/0295738 | A1* | 9/2019 | Ponard | H01J 35/16 |

FOREIGN PATENT DOCUMENTS

| | | | |
|---|---|---|---|
| KR | 10-2017-0022852 | A | 3/2017 |
| KR | 10-2019-0119528 | A | 10/2019 |

* cited by examiner

X-RAY TUBE

CROSS-REFERENCE TO RELATED APPLICATIONS

This U.S. non-provisional patent application claims priority under 35 U.S.C. § 119 of Korean Patent Application Nos. 10-2021-0055725, filed on Apr. 29, 2021, and 10-2022-0023495, filed on Feb. 23, 2022, the entire contents of which are hereby incorporated by reference.

BACKGROUND

The present disclosure herein relates to an X-ray tube.

The X-ray tubes generate electrons in a vacuum container and accelerate the electrons in a direction of an anode electrode to which a high voltage has been applied, and accordingly, the electrons collide with a metal target on the anode electrode, and X-rays are generated. Here, a difference in voltage between the anode electrode and a cathode electrode is defined as an acceleration voltage that accelerates the electrons. Depending on the use of the X-ray tubes, the electrons are accelerated by the acceleration voltage of several to several hundreds of kV. A gate electrode or the like is provided between the anode electrode and the cathode electrode.

SUMMARY

The present disclosure provides a structure of an X-ray tube that stably operates even at a high voltage.

An embodiment of the inventive concept provides an X-ray tube including: a first electrode; a second electrode spaced apart from the first electrode; a target disposed in a lower portion of the second electrode; an emitter on the first electrode; a third electrode which is positioned between the first electrode and the second electrode and includes an opening at a position perpendicularly corresponding to the emitter; and a spacer provided on the third electrode and surrounding the second electrode, wherein the spacer includes a first section located adjacent to the third electrode and a second section disposed on the first section, and the spacer includes a ceramic insulator and conductive dopants dispersed within the ceramic insulator, wherein a concentration of the conductive dopants in the first section of the spacer is greater than a concentration of the conductive dopants in the second section, and the third electrode is in contact with the first section of the spacer.

In an embodiment, each of the first to third electrodes may include metal, and the third electrode may be a metal electrode located closest to the first electrode.

In an embodiment, a level of a contact point between the first section and the second section of the spacer may be lower than a level of the lowermost portion of the target.

In an embodiment, the X-ray tube may further include a fourth electrode interposed between the second electrode and the third electrode, wherein the fourth electrode is located closer to the third electrode than the second electrode.

In an embodiment, the ceramic insulator may include one of alumina ($Al_2O_3$), zirconia ($ZrO_2$), or yttria ($Y_2O_3$), and the conductive dopants may include titania ($TiO_2$).

In an embodiment, volume resistivity of the first section of the spacer is less than volume resistivity of the second section.

In an embodiment, the first section of the spacer may have resistivity less than or equal to about $10^{12}$ Ω·cm, and the second section of the spacer may have resistivity greater than about $10^{12}$ Ω·cm.

In an embodiment, the spacer may have a cylindrical tubular shape, and the X-ray tube may further include a metal film provided on an outer circumferential surface of the first section of the spacer, wherein the metal film is connected to a ground power supply.

In an embodiment, the metal film may be in contact with the first section of the spacer.

In an embodiment, the metal film may be electrically connected to the first section of the spacer.

In an embodiment, the ceramic insulator may include alumina ($Al_2O_3$), and the conductive dopants include titania ($TiO_2$), wherein a concentration of the titania ($TiO_2$) in the first section of the spacer is greater than or equal to about 2 wt %, and a concentration of the titania ($TiO_2$) in the second section of the spacer is greater than about 0 and less than about 2 wt %.

In an embodiment, the X-ray tube may further include a conductive structure interposed between the spacer and the third electrode, wherein the conductive structure includes a Kovar alloy.

In an embodiment, the conductive structure may have a tubular shape and is bent, and the X-ray tube further may include a window that passes through the conductive structure.

In an embodiment of the inventive concept, an X-ray tube includes: a cathode electrode; an anode electrode spaced perpendicularly from the cathode electrode; a target disposed in a lower portion of the anode electrode; an emitter on the cathode electrode; and a spacer provided on the cathode electrode and surrounding the anode electrode, wherein the spacer includes a ceramic insulator and conductive dopants dispersed within the ceramic insulator, and the spacer includes a first section located adjacent to the cathode electrode and a second section disposed on the first section, wherein a concentration of the conductive dopants in the first section of the spacer is greater than a concentration of the conductive dopants in the second section.

In an embodiment of the inventive concept, an X-ray tube includes: a cathode electrode; an anode electrode spaced perpendicularly from the cathode electrode; a target disposed in a lower portion of the anode electrode; an emitter on the cathode electrode; a gate electrode which is positioned between the cathode electrode and the anode electrode and includes an opening at a position perpendicularly corresponding to the emitter; and a spacer provided on the gate electrode and surrounding the anode electrode, wherein the spacer includes a first section located adjacent to the gate electrode and a second section disposed on the first section, wherein the first section of the spacer includes a first ceramic insulator, and the second section includes a second ceramic insulator, wherein the first ceramic insulator includes a metal oxide different from the second ceramic insulator, and resistivity of the first ceramic insulator is less than resistivity of the second ceramic insulator, wherein a level of a contact point between the first section and the second section of the spacer is lower than a level of the lowermost portion of the target.

In an embodiment, the X-ray tube may further include conductive dopants dispersed in the first ceramic insulator.

In an embodiment, the first section of the spacer may have resistivity less than or equal to about $10^{12}$ Ω·cm, and the second section of the spacer may have resistivity greater than about $10^{12}$ Ω·cm.

In an embodiment, the spacer may have a cylindrical tubular shape, and the X-ray tube further may include a metal film provided on an outer circumferential surface of the first section of the spacer, wherein the metal film is connected to a ground power supply.

In an embodiment, the X-ray tube may further include a conductive structure interposed between the spacer and the gate electrode, wherein the conductive structure includes a Kovar, and the conductive structure is connected to a ground power supply.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Embodiments of the present disclosure will be described with reference to the accompanying drawings so as to sufficiently understand constitutions and effects of the present disclosure. The present disclosure may, however, be embodied in different forms and diversely modified, and should not be construed as limited to the embodiments set forth herein. Rather, these embodiments are provided so that this disclosure will be thorough and complete, and will fully convey the scope of the present disclosure to a person skilled in the art to which the present disclosure pertains. In the attached drawings, sizes of elements are enlarged rather than real sizes thereof for convenience of description, and ratios of respective elements may be exaggerated or reduced.

Unless otherwise defined, all terms used in embodiments of the inventive concept have the same meaning as commonly understood by one of ordinary skill in the art to which the present disclosure belongs. Hereinafter, the present disclosure will be described in detail by explaining embodiments of the inventive concept with reference to the accompanying drawing.

Figure 1:
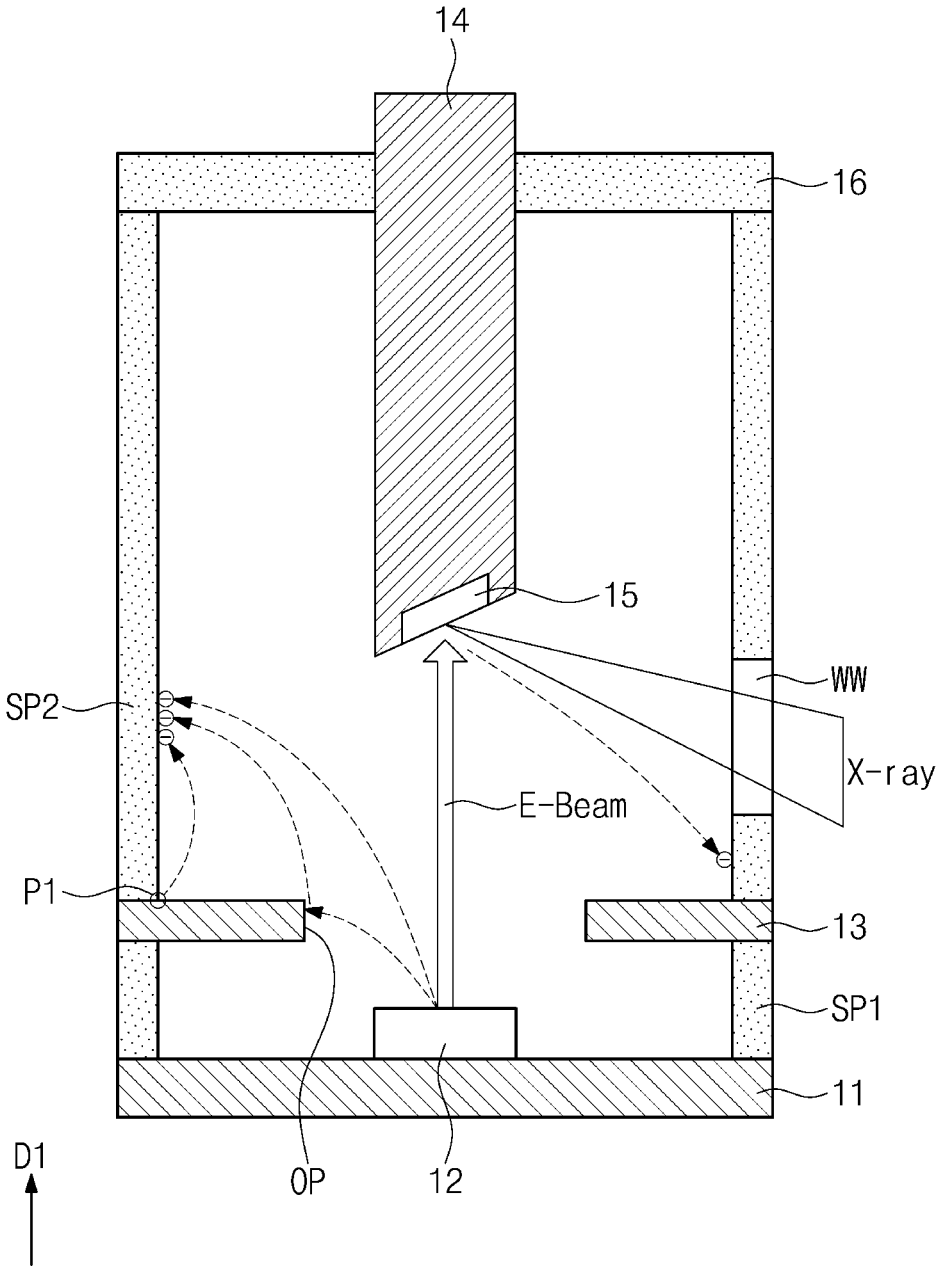
FIG. 1 is a cross-sectional view schematically showing a structure of an X-ray tube.

FIG. 1 is a cross-sectional view schematically showing a structure of an X-ray tube.

Referring to FIG. 1, the X-ray tube may include a cathode electrode 11, an emitter 12, an anode electrode 14, a target 15, a gate electrode 13, a first spacer SP1, a second spacer SP2, and a vacuum cap 16. In the specification, the cathode electrode 11 may be referred as a first electrode 11, the anode electrode 14 may be referred to as a second electrode 14, and the gate electrode 13 may be referred to as a third electrode 13.

The cathode electrode 11 and the anode electrode 14 may be positioned so as to face each other and spaced apart from each other along a first direction D1. In the specification, the first direction D1 may represent a direction perpendicular to the top surface of the cathode electrode 11. Alternatively, the first direction D1 indicates a direction directed from the cathode electrode 11 toward the anode electrode 14.

The cathode electrode 11, the anode electrode 14, and the gate electrode 13 may be electrically connected to external power supplies (not shown). For example, a positive voltage or a negative voltage may be applied to the cathode electrode 11, or a ground power supply may be connected thereto. A voltage having a higher electric potential may be applied to both the anode electrode 14 and the gate electrode 13 than the cathode electrode 11.

The anode electrode 14, the cathode electrode 11, and the gate electrode 13 may include conductive materials, and the conductive materials may include, for example, metal materials such as copper (Cu), aluminum (Al), molybdenum (Mo), and the like. The anode electrode 14 may be a rotary anode electrode that rotates in one direction or a stationary anode electrode.

The gate electrode 13 may be positioned between the emitter 12 and the anode electrode 14. The gate electrode 13 may be located closer to the emitter 12 than the anode electrode 14. The gate electrode 13 is positioned above the cathode electrode 11 and may include an opening OP at a position corresponding to the emitter 12.

The target 15 may be provided below the anode electrode 14. The lower surface of the target 15, that is, a surface of the target 15 facing the cathode electrode 11 may be inclined. According to embodiments, the target 15 may include the same material as the anode electrode 14. In this case, the target 15 may be a portion of the anode electrode 14, on which an E-beam is focused. According to embodiments, the target 15 may include a material different from that of the anode electrode 14.

For example, the target 15 may include at least one of molybdenum (Mo), tantalum (Ta), tungsten (W), copper (Cu), or gold (Au).

The emitter 12 may include metal filaments or carbon nanotubes. For one example, the metal filaments may be generally made of a material such as tungsten (W) having a high melting point and a high boiling point. The filaments are heated to a high temperature by electric current supplied from the cathode electrode 11. The filaments emit thermal electrons in a high-temperature state, and the emitted thermal electrons are accelerated by an electric potential difference between both electrodes of the cathode electrode 11 and the anode electrode 14. For another example, the emitter 12 may be arranged in the form of dot arrays made of carbon nanotubes or may have the form of yarns made by twisting carbon nanotubes.

When the emitter 12 has the form of dot arrays of carbon nanotubes or is constituted by a plurality of carbon nanotube yarns, the gate electrode 13 may include a plurality of openings OP to induce a high electric field at the dot arrays of carbon nanotubes (or carbon nanotube yarns) and then to emit electrons from the dot arrays of carbon nanotubes. The gate electrode 13 may have a mesh shape or a grid shape.

The electron (E)-beam emitted from the emitter 12 may be generated and accelerated in a vacuum state. The E-beam emitted from the emitter 12 may be focused on the target 15 after passing through the opening OP of the gate electrode 13. The E-beam collides with the target 15, and an X-ray is generated. The X-ray may be emitted to the outside via a window WW that passes through the second spacer SP2. The window WW may include a material that is made of beryllium (Be), copper (Cu), and the like and hardly absorbs the X-ray.

In order to create the vacuum state, the X-ray tube may be manufactured in a completely sealed state. Alternatively, depending on a manufacturing method, the inside of the X-ray tube may be in the vacuum state by a vacuum pump (not shown) connected to the outside.

Each of the first spacer SP1 and the second spacer SP2 may have a cylindrical tubular shape. The first spacer SP1 may be interposed between the cathode electrode 11 and the gate electrode 13. The second spacer SP2 may be interposed between the gate electrode 13 and the anode electrode 14.

The first spacer SP1 and the second spacer SP2 may include a material which is strong even in the vacuum state. For one example, the first spacer SP1 and the second spacer SP2 may include a ceramic insulator. The second spacer SP2 will be described in detail in FIG. 2.

The X-ray tube according to embodiments may further include at least one focusing electrode. The focusing electrode may be positioned between the gate electrode 13 and the anode electrode 14. The focusing electrode may be located closer to the gate electrode 13 than the anode electrode 14. The focusing electrode may have a similar shape as the gate electrode 13.

Some electrons of the E-beam-emitted from the emitter 12 deviate from a normal trajectory and may collide with the second spacer SP2. Under a high-voltage condition, electrons other than those of the E-beam emitted from the emitter 12 may be emitted from a triple point (or junction). The triple point is involved in a point at which a vacuum, a metal, and an insulator having different dielectric constants meet each other. In the X-ray tube, a triple point limitation may be most serious at a point P1 at which the gate electrode 13 meets the insulator of the second spacer SP2 (when the focusing electrode is present, a point at which the focusing electrode meets the insulator of the second spacer SP2) due to a high voltage applied to the anode electrode 14. That is, an intense electric field is induced at the triple point P1 due to the high voltage applied to the anode electrode 14, and accordingly, undesirable electrons may be emitted from the triple point P1. The emitted electrons may collide with the second spacer SP2. Also, some electrons of the E-beam collide with the target 15 and scattered, and then may collide with the second spacer SP2.

As the electrons collide with the second spacer SP2, secondary electrons may be emitted from the second spacer SP2, and then the second spacer SP2 may be positively charged. When the second spacer SP2 is charged under a high voltage, there is a risk that an arc occurs, and this may affect operation stability, that is, reliability of the X-ray tube.

Figure 2:
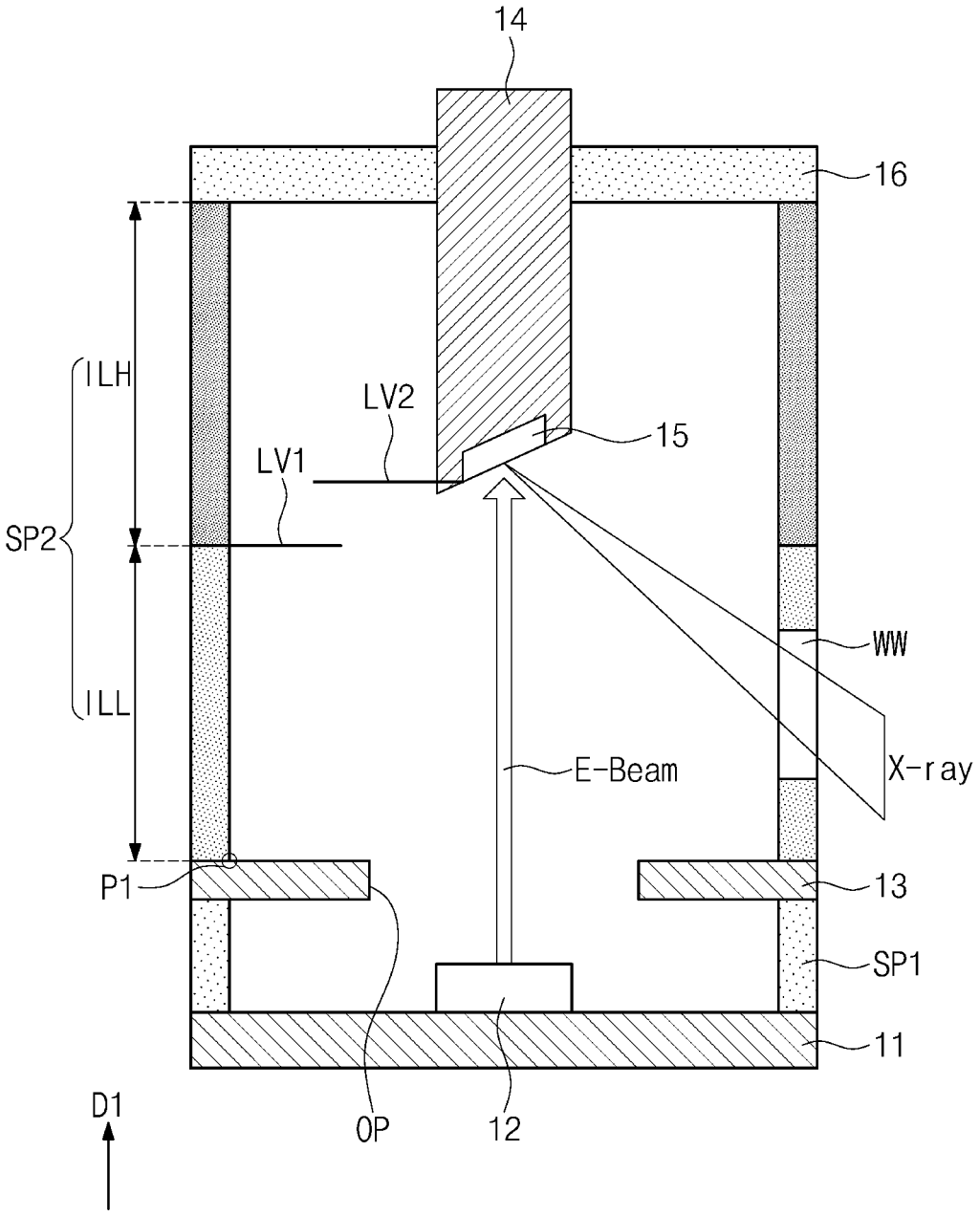
FIG. 2 is a cross-sectional view showing a structure of an X-ray tube according to the inventive concept.

FIG. 2 is a cross-sectional view showing a structure of an X-ray tube according to the inventive concept. Since features other than described below overlap with those described in FIG. 1, overlapping descriptions will be omitted.

Referring to FIG. 2, a second spacer SP2 may include a first section ILL and a second section ILH which are connected to each other. The first section ILL and the second section ILH may constitute one body of the second spacer SP2. The first section ILL and the second section ILH of the second spacer SP2 may surround an anode electrode 14. The first section ILL may be positioned closer to a gate electrode 13 than the second section ILH.

The first section ILL may include a low-resistivity insulator, and the second section ILH may include a high-resistivity insulator. In the specification, the low-resistivity insulator and the high-resistivity insulator are defined according to the degree of volume resistivity (or resistivity). The low-resistivity insulator may be defined as a material having resistivity less than or equal to about $10^{12}$ Ω·cm, and the high-resistivity insulator may be defined as a material resistivity greater than about $10^{12}$ Ω·cm.

The low-resistivity insulator and the high-resistivity insulator may include a ceramic insulator and conductive dopants dispersed within the ceramic insulator. According to embodiments, the high-resistivity insulator may include few conductive dopants. The conductive dopants may be uniformly distributed within the ceramic insulator.

The ceramic insulator may include, for example, at least one of alumina ($Al_2O_3$), zirconia ($ZrO_2$), or yttria ($Y_2O_3$). The conductive dopants may include titanium oxide ($Ti_xO_y$, x=1 to 3, y=1 to 3). For another example, the conductive dopants may include chromium oxide ($Cr_2O_3$). For one example, the ceramic insulator may include alumina ($Al_2O_3$), and the conductive dopants may include titania ($TiO_2$). An amount of the conductive dopants within the low-resistivity insulator may be greater than or equal to about 2 wt %. An amount of the conductive dopants within the high-resistivity insulator may be less than about 2 wt %.

When both the first section ILL and the second section ILH include titanium oxide ($Ti_xO_y$, x=1 to 3, y=1 to 3), a concentration of $Ti_2O_3$ and/or TiO within the first section ILL may be greater than a concentration of $Ti_2O_3$ and/or TiO within the second section ILH.

The second spacer SP2 may further include additives and other impurities. The types and amounts of additives and other impurities within the first section ILL and the second section ILH of the second spacer SP2 may be substantially equal to each other. The total amounts of additives within the second spacer SP2 may be about 1 wt % to about 4 wt %. The total amounts of impurities within the second spacer SP2 may be less than about 2 wt %. The additives may include materials, such as silicon oxide ($SiO_2$) and manganese dioxide ($MnO_2$), that increase rigidity of the second spacer SP2 and increase adhesive strength with electrodes during a brazing process which will be described later. The impurities may include carbon and other oxides.

According to embodiments, the first section ILL and the second section ILH of the second spacer SP2 may include different types of ceramic insulators. The first section ILL may include a first ceramic insulator having low resistivity, and the second section ILH may include a second ceramic insulator having higher resistivity than the first ceramic insulator. The first ceramic insulator and the second ceramic insulator may include metal oxides made of different materials. According to embodiments, the first section ILL may further include conductive dopants.

A triple point P1, which is the biggest limitation in operating the X-ray tube, is involved in a point at which the vacuum, the nearest electrode (e.g., the gate electrode 13), and the first section ILL of the second spacer SP2 meet each other. The first section ILL of the second spacer SP2 includes a low-resistivity insulator, and thus, the generation of electrons at the triple point P1 may be suppressed. Also, even if the electrons are scattered to the first section ILL, it is possible to prevent the secondary electrons from being generated. On the other hand, the second section ILH of the second spacer SP2 is a portion in which electrons are not easily generated and the collision frequency of scattered electrons is low. The second section ILH of the second spacer SP2 includes a high-resistivity insulator, and thus, the X-ray tube may maintain an insulation state even in a high-voltage state.

A first level LV1 of a contact point between the first section ILL and the second section ILH may be lower than a second level LV2 of the lowermost portion of a target 15. That is, the first level LV1 may be substantially the same as a level LV1 of the uppermost portion of the first section ILL, and the level of the lowermost portion of the first section ILL may be higher than the level of the uppermost portion of an emitter 12.

In order for the X-ray tube to maintain insulation in the high-voltage state, at least a certain ratio of the second section ILH is required within the second spacer SP2. Unlike the embodiments of the inventive concept, in case of a configuration in which the second level LV2 is lower than the first level LV1, the anode electrode 14 extends along a first direction D1 so that the target 15 is closer to the cathode electrode 11 than the contact point between the first section ILL and the second section ILH. In this case, the emitter 12 and the target 15 are positioned adjacent to each other, a portion of scattered electrons generated due to collision between an E-beam and the target 15 may collide with the emitter 12. Thus, there is a risk of damage to the emitter 12. According to the inventive concept, the target 15 is located higher than the contact point between the first section ILL and the second section ILH, and it is possible to prevent the scattered electrons generated in the target 15 from colliding with the emitter 12. Thus, reliability of the X-ray tube may increase.

The second spacer SP2 according to the inventive concept may be formed through the following method. For one example, on the basis of the total weight of an alumina ($Al_2O_3$) insulator in which additives are included, greater than about 2 wt % of titania ($TiO_2$) is added to a portion (corresponding to the first section ILL of the second spacer SP2) of the alumina, and no greater than about 2 wt % of titania ($TiO_2$) is added to the remainder (corresponding to the second section ILH of the second spacer SP2). Then, the resultant may be sintered. As high-temperature heat treatment is performed in a hydrogen gas atmosphere, the first section ILL and the second section ILH of the second spacer SP2 may be formed. At least a portion of titanium dioxide ($TiO_2$) may be reduced in the hydrogen gas atmosphere and form $Ti_2O_3$ and/or TiO. Additionally, a metallizing process may be performed on a portion in contact with the gate electrode 13. The adhesive strength between the second spacer SP2 and the gate electrode 13 may be increased in a vacuum state through the metallizing process (brazing bonding).

Figure 3:
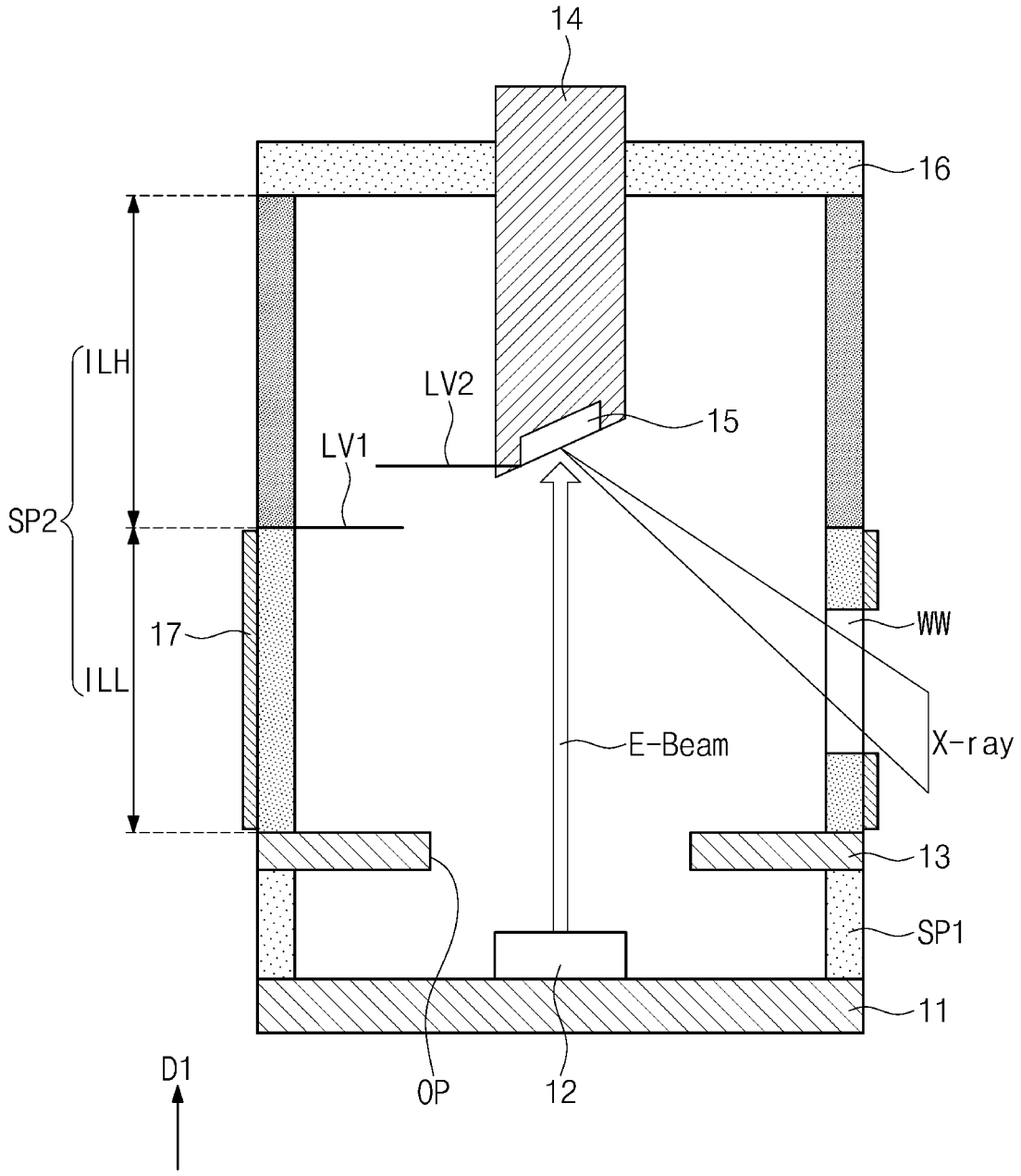
FIG. 3 is a cross-sectional view showing a structure of an X-ray tube according to embodiments.

FIG. 3 is a cross-sectional view showing a structure of an X-ray tube according to embodiments. Since features other than described below overlap with those described in FIG. 2, overlapping descriptions will be omitted.

Referring to FIG. 3, a metal film 17 may be selectively provided on the outer circumferential surface of a first section ILL of a second spacer SP2. The metal film 17 may be in direct contact with the first section ILL of the second spacer SP2. According to embodiments, the metal film 17 may be electrically connected to the first section ILL of the second spacer SP2 through an additional connection means. The metal film 17 may not be provided on the outer circumferential surface of a second section ILH of the second spacer SP2. Also, the metal film 17 may not be provided on the inner circumferential surface of the second spacer SP2.

The metal film 17 may include a metal material such as, for example, copper. The metal film 17 may be a thin film (e.g., the thickness less than or equal to about 1 μm) directly applied on the first section ILL or a metal thick film (e.g., the thickness greater than about 1 μm) in the form of bulk. The metal film 17 is connected to a ground power supply and may remove electric charges that collide with the first section ILL.

Figure 4:
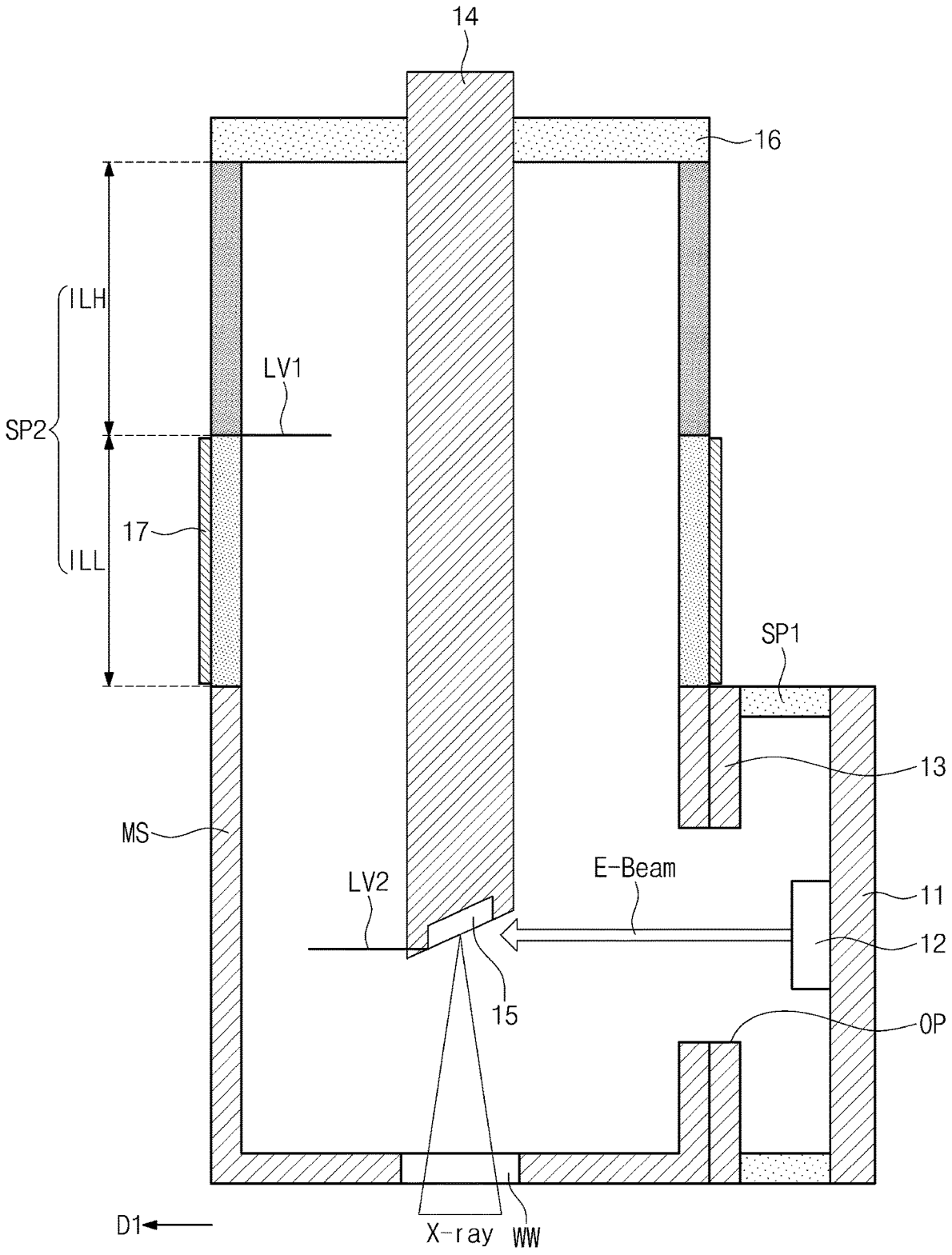
FIG. 4 is a cross-sectional view showing a structure of an X-ray tube according to embodiments.

FIG. 4 is a cross-sectional view showing a structure of an X-ray tube according to embodiments. Since features other than described below overlap with those described in FIG. 3, overlapping descriptions will be omitted.

Referring to FIG. 4, an X-ray tube according to embodiments may include a conductive structure MS which is provided between a second spacer SP2 and a gate electrode 13. The conductive structure MS may include, for example, a metal alloy. The metal alloy may include Kovar or Super Kovar which includes iron, nickel, and cobalt.

The conductive structure MS has a tubular shape and may be bent. For one example, one side surface of the conductive structure MS may have a "L" shape. An emitter 12 may be horizontally spaced apart from a target 15, and a window WW may be perpendicularly spaced apart from the target 15. The positions and arrangements of the emitter 12, the target 15, and the window WW may be adjusted by adjusting the shape of the conductive structure MS.

The window WW may be formed in a region of the conductive structure MS which perpendicularly overlaps the target 15. Specifically, the window WW may be formed by passing through the conductive structure MS. The conductive structure MS may be connected to a ground power supply.

It is possible to suppress generation of electrons at a triple point at which the conductive structure MS is in contact with the second spacer SP2, and the scattered electrons may be removed through the conductive structure MS and/or a metal film 17 which are connected to the ground power supply.

According to embodiments, the first spacer SP1 in FIGS. 2 to 4 may also have a first section ILL having low resistivity and a second section ILH having high resistivity, as in the second spacer SP2.

The X-ray tube according to the embodiment of the inventive concept includes the spacer that includes the first and second sections having different resistivity. The first section of the spacer is in contact with the electrode, which is closest to the anode electrode, among the electrodes interposed between the cathode electrode and the anode electrode. The resistivity of the first section of the spacer is adjusted to be lower than the resistivity of the second section, and thus, it is possible to stably operate the X-ray tube even at the high voltage. Also, the contact position between the first section and the second section is positioned lower than the lowermost portion of the target, and thus, reliability of the X-ray tube can increase.

The embodiments of the inventive concept have been described with reference to the accompanying drawings, but the present disclosure may be embodied in other specific forms without changing the technical idea or essential features. Therefore, the above-described embodiments are to be considered in all aspects as illustrative and not restrictive.

What is claimed is:

1. An X-ray tube, comprising:

a first electrode;

a second electrode spaced apart from the first electrode;

a target disposed in a lower portion of the second electrode;

an emitter disposed on the first electrode;

a third electrode which is positioned between the first electrode and the second electrode and comprising an opening at a position perpendicularly corresponding to the emitter; and a spacer provided on the third electrode and surrounding the second electrode, wherein the spacer comprises a first section located adjacent to the third electrode and a second section disposed on the first section, wherein the spacer comprises a ceramic insulator and conductive dopants dispersed within the ceramic insulator, wherein a concentration of the conductive dopants in the first section of the spacer is greater than a concentration of the conductive dopants in the second section, wherein the third electrode is in contact with the first section of the spacer, and wherein the first electrode comprises a cathode electrode, the second electrode comprises an anode electrode and the third electrode comprises a gate electrode.

2. The X-ray tube of claim 1, wherein each of the first to third electrodes comprises metal, and the third electrode is a metal electrode located closest to the first electrode.

3. The X-ray tube of claim 1, wherein a level of a contact point between the first section and the second section of the spacer is lower than a level of the lowermost portion of the target.

4. The X-ray tube of claim 1, further comprising a focusing electrode interposed between the second electrode and the third electrode, wherein the focusing electrode is located closer to the third electrode than the second electrode.

5. The X-ray tube of claim 1, wherein the ceramic insulator comprises one of alumina ($Al_2O_3$), zirconia ($ZrO_2$), or yttria ($Y_2O_3$), and the conductive dopants comprise titania ($TiO_2$).

6. The X-ray tube of claim 1, wherein volume resistivity of the first section of the spacer is less than volume resistivity of the second section.

7. The X-ray tube of claim 1, wherein the first section of the spacer has resistivity less than or equal to about $10^{12}$ Ω·cm, and the second section of the spacer has resistivity greater than about $10^{12}$ Ω·cm.

8. The X-ray tube of claim 1, wherein the spacer has a cylindrical tubular shape, and the X-ray tube further comprises a metal film provided on an outer circumferential surface of the first section of the spacer, wherein the metal film is connected to a ground power supply.

9. The X-ray tube of claim 8, wherein the metal film is in contact with the first section of the spacer.

10. The X-ray tube of claim 8, wherein the metal film is electrically connected to the first section of the spacer.

11. The X-ray tube of claim 1, wherein the ceramic insulator comprises alumina ($Al_2O_3$), and the conductive dopants comprise titania ($TiO_2$), wherein a concentration of the titania ($TiO_2$) in the first section of the spacer is greater than or equal to about 2 wt %, and a concentration of the titania ($TiO_2$) in the second section of the spacer is greater than about 0 and less than about 2 wt %.

12. The X-ray tube of claim 1, further comprising a conductive structure interposed between the spacer and the third electrode, wherein the conductive structure comprises a nickel-cobalt ferrous alloy compositionally identical to Fernico 1.

13. The X-ray tube of claim 12, wherein the conductive structure has a tubular shape and is bent, and the X-ray tube further comprises a window that passes through the conductive structure.

14. An X-ray tube, comprising:

a cathode electrode;

an anode electrode spaced perpendicularly from the cathode electrode;

a target disposed in a lower portion of the anode electrode;

an emitter disposed on the cathode electrode; and a spacer provided on the cathode electrode and surrounding the anode electrode, wherein the spacer comprises a ceramic insulator and conductive dopants dispersed within the ceramic insulator, and the spacer comprises a first section located adjacent to the cathode electrode and a second section disposed on the first section, and wherein a concentration of the conductive dopants in the first section of the spacer is greater than a concentration of the conductive dopants in the second section.

15. An X-ray tube, comprising:

a cathode electrode;

an anode electrode spaced perpendicularly from the cathode electrode;

a target disposed in a lower portion of the anode electrode;

an emitter disposed on the cathode electrode;

a gate electrode which is positioned between the cathode electrode and the anode electrode and comprises an opening at a position perpendicularly corresponding to the emitter; and a spacer provided on the gate electrode and surrounding the anode electrode, wherein the spacer comprises a first section located adjacent to the gate electrode and a second section disposed on the first section, wherein the first section of the spacer comprises a first ceramic insulator, and the second section comprises a second ceramic insulator, wherein the first ceramic insulator comprises a metal oxide different from the second ceramic insulator, and resistivity of the first ceramic insulator is less than resistivity of the second ceramic insulator, and wherein a level of a contact point between the first section and the second section of the spacer is lower than a level of the lowermost portion of the target.

16. The X-ray tube of claim 15, further comprising conductive dopants dispersed in the first ceramic insulator.

17. The X-ray tube of claim 15, wherein the first section of the spacer has resistivity less than or equal to about $10^{12}$ Ω·cm, and the second section of the spacer has resistivity greater than about $10^{12}$ Ω·cm.

18. The X-ray tube of claim 15, wherein the spacer has a cylindrical tubular shape, and the X-ray tube further comprises a metal film provided on an outer circumferential surface of the first section of the spacer, wherein the metal film is connected to a ground power supply.

19. The X-ray tube of claim 15, further comprising a conductive structure interposed between the spacer and the gate electrode, wherein the conductive structure comprises a nickel-cobalt ferrous alloy compositionally identical to Fernico 1, and the conductive structure is connected to a ground power supply.

20. The X-ray tube of claim 19, wherein the conductive structure has a tubular shape and is bent, and the X-ray tube further comprises a window that passes through the conductive structure.

* * * * *